US012098605B2

(12) United States Patent
Pye et al.

(10) Patent No.: US 12,098,605 B2
(45) Date of Patent: Sep. 24, 2024

(54) DRILLING TRACTOR TOOL

(71) Applicant: SAUDI ARABIAN OIL COMPANY, Dhahran (SA)

(72) Inventors: Richard Mark Pye, Aberdeenshire (GB); Rae Andrew Younger, Aberdeenshire (GB)

(73) Assignee: Saudi Arabian Oil Company, Dhahran (SA)

( * ) Notice: Subject to any disclaimer, the term of this patent is extended or adjusted under 35 U.S.C. 154(b) by 93 days.

(21) Appl. No.: 18/047,962

(22) Filed: Oct. 19, 2022

(65) Prior Publication Data

US 2024/0133256 A1 Apr. 25, 2024
US 2024/0229583 A9 Jul. 11, 2024

(51) Int. Cl.
*E21B 23/00* (2006.01)

(52) U.S. Cl.
CPC ..... *E21B 23/001* (2020.05)

(58) Field of Classification Search
CPC . E21B 4/18; E21B 4/20; E21B 23/001; E21B 7/068
See application file for complete search history.

(56) References Cited

U.S. PATENT DOCUMENTS 5,467,834 A * 11/1995 Hughes ..... E21B 7/062 175/325.1
6,032,748 A 3/2000 DeBray et al.
6,347,674 B1 * 2/2002 Bloom ..... E21B 33/127 175/98
6,460,616 B1 10/2002 Simpson
6,953,086 B2 10/2005 Simpson
7,051,587 B2 5/2006 Simpson et al.
9,624,723 B2 4/2017 Fraser
10,927,625 B2 2/2021 Fleckenstein et al.
(Continued)

FOREIGN PATENT DOCUMENTS

CN 205370484 U 7/2016
WO 2012/143722 A2 10/2012

OTHER PUBLICATIONS

International Search Report and Written Opinion issued in corresponding International Application No. PCT/US2023/077280, dated Jan. 3, 2024 (11 pages).
(Continued)

*Primary Examiner* — David Carroll
(74) *Attorney, Agent, or Firm* — Osha Bergman Watanabe & Burton LLP

(57) ABSTRACT

A drilling tractor tool in a drill string includes a rotating mandrel having an engagement part configured to rotate with the drill string; and a static sleeve disposed on the rotating mandrel configured to remain stationary during rotation of the rotating mandrel. The static sleeve includes a plurality of pockets that form a pathway from an interior of the static sleeve to an exterior of the static sleeve. The drilling tractor tool includes a plurality of force applicators each disposed in a respective pocket of the plurality of pockets of the static sleeve. The plurality of force applicators configured to extend through the respective pocket and apply a forward thrust to the drill string when extended. The engagement part of the rotating mandrel is configured to contact and cause to extend each of the plurality of force applicators respectively as the rotating mandrel rotates.

20 Claims, 9 Drawing Sheets

(56) References Cited

U.S. PATENT DOCUMENTS

| | | | | |
|---|---|---|---|---|
| 2004/0045474 | A1* | 3/2004 | Simpson | E21B 23/08 104/138.2 |
| 2012/0012337 | A1* | 1/2012 | Hall | E21B 4/18 166/381 |
| 2012/0061074 | A1 | 3/2012 | Bloom et al. | |
| 2013/0333949 | A1 | 12/2013 | Simpson | |

OTHER PUBLICATIONS

Giem, et al.; "Wireline tractor for through-tubing Intervention in Wells with Barefoot Openhole Completions"; Society of Petroleum Engineers; SPE-189923-MS; Mar. 27, 2018 (11 pages).

* cited by examiner

DRILLING TRACTOR TOOL

BACKGROUND

The disclosure relates generally to drilling of holes from the surface of the earth to subterranean reservoirs. Fluid is typically produced from a reservoir in a subterranean formation by drilling a wellbore into the subterranean formation, establishing a flow path between the reservoir and the wellbore, and conveying the fluids from the reservoir to the surface through the wellbore. Fluids produced from a hydrocarbon reservoir may include natural gas, oil, and water.

During drilling operations in high inclination wells and extended reach drilling (ERD) wells, it is common to experience pipe buckling and twist-offs due to unsuccessfully getting weight to the drill bit. Pipe buckling is known in the industry as pipe failure under pressure. Twist-offs are known in the industry as the breaking of pipe due to excessive torque.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a drilling tractor tool in a drill string comprising: a rotating mandrel having an engagement part configured to rotate with the drill string; a static sleeve disposed on the rotating mandrel configured to remain stationary during rotation of the rotating mandrel, the static sleeve comprising a plurality of pockets that form a pathway from an interior of the static sleeve to an exterior of the static sleeve; and a plurality of force applicators each disposed in a respective pocket of the plurality of pockets of the static sleeve, the plurality of force applicators configured to extend through the respective pocket and apply a forward thrust to the drill string when extended, wherein the engagement part of the rotating mandrel is configured to contact and cause to extend each of the plurality of force applicators respectively as the rotating mandrel rotates.

In one aspect, embodiments disclosed herein relate to a method for drilling a wellbore, the method comprising: disposing a plurality of force applicators into pockets within a static sleeve; attaching the static sleeve to a rotating mandrel having an engagement part so as to form a drilling tractor tool, wherein the static sleeve and the rotating mandrel are attached such that rotation of the rotating mandrel displaces the plurality of force applicators from the pockets within the static sleeve as the rotating mandrel rotates thereby bringing the engagement part into and out of contact with the static sleeve; attaching the drilling tractor tool to a drill string in the wellbore; applying a rotational torque to the drilling tractor tool, via a well component, to rotate the rotating mandrel, wherein the rotational torque is converted to a forward thrust, through the displacement of the plurality of force applicators via the engagement part coming in contact with the static sleeve, and wherein the plurality of force applicators retract via the engagement part coming out of contact with the static sleeve.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
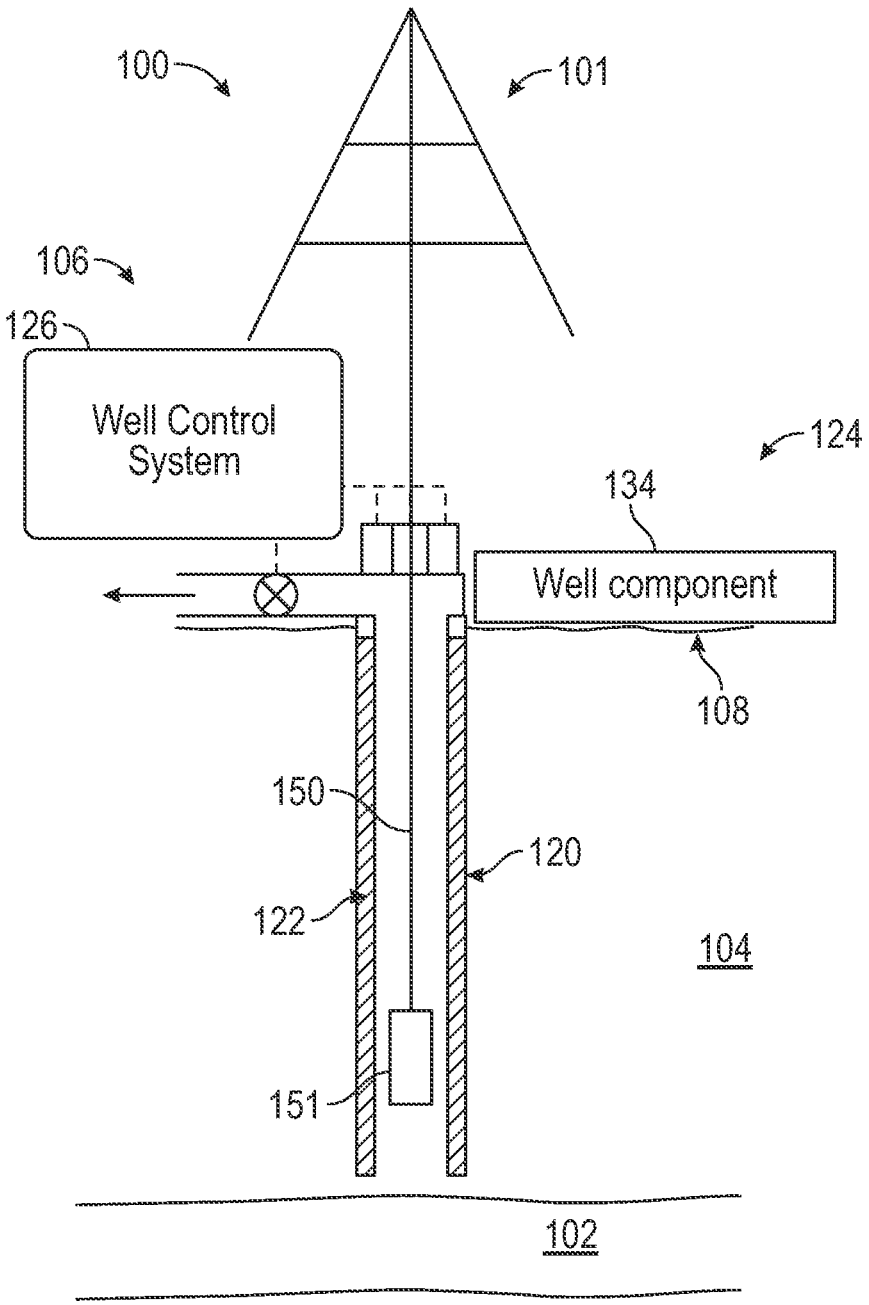
FIG. 1 shows a system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-13, any component described regarding a figure, in various embodiments disclosed herein, may be equivalent to one or more like-named components described with regard to any other figure. For brevity, descriptions of these components will not be repeated regarding each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a force applicator" includes reference to one or more of such force applicators.

Embodiments disclosed herein relate to a system and a method for a drilling tractor tool. In one or more embodiments, the downhole device converts available rotary power into forward axial motion, as well as, may provide lift and thrust to prevent pipe buckling and twist-offs. Various embodiments of the design may provide several benefits, such as: (a) getting weight to the drill bit in high angle and Extended Reach Drilling (ERD) wells to prevent pipe buckling and twist-offs; (b) Assisting in delivery of completion strings after drilling where circulating flow might be used to power the drilling tractor tool. The axial forces generated by the drilling tractor tool may run the completion string to the correct location; and (c) dragging the casing into the well after drilling when the well is usually cased off. The stiffness of the casing and increased friction commonly cause difficulty in getting the casing to bottom. The drilling tractor tool may be used below the motor behind a reamer shoe. The casing may be rotated, or a sacrificial motor may be used to power a reamer shoe to get past obstacles and restrictions in the well. Special casing tractors may be deployed along the length.

FIG. 1 shows a schematic diagram in accordance with one or more embodiments. As shown in FIG. 1, a well environment (100) includes a subterranean formation ("formation") (104) and a well system (106). The formation (104) may include a porous or fractured rock formation that resides underground, beneath the surface of the earth or beneath a seabed ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102) (hereafter "reservoir"). In the case of the well system (106) being operated as a production well, the well system (106) may facilitate the extraction of hydrocarbons (or "production") from the reservoir (102).

In some embodiments disclosed herein, the well system (106) includes a rig (101), a wellbore (120), a well subsurface system (122), a well surface system (124), and a well control system (126). The well control system (126) may control various operations of the well system (106), such as well production operations, well drilling operations, well completion operations, well maintenance operations, and reservoir monitoring, assessment, and development operations.

The rig (101) is the machine used to drill a borehole to form the wellbore (120) by rotating a drilling bit. The drill bit may be referred to as "bit". The wellbore (120) may be vertical, inclined, and/or horizontal. Major components of the rig (101) include the drilling fluid tanks, the drilling fluid pumps (e.g., rig mixing pumps), the derrick or mast, the draw works, the drill string (150), the power generation equipment and auxiliary equipment. A key component of the rig (101) may include a well component (134) for providing rotation and torque to the drill bit. A few key advantages to rotating the drill string (150) may include reduced drag, improved hole cleaning, and faster drilling. The well component (134) may be on surface (108) or downhole. The well component (134) on surface (108) may be a rotary table or top drive. The rig (101) may be replaced with a Coiled Tubing Unit and require drilling fluid and mud motors/turbines as the well component (134) to generate rotation for the drill bit.

Drilling fluid, also referred to as "drilling mud" or simply "mud," is used to facilitate drilling boreholes into the earth, such as drilling oil and natural gas wells. The main functions of drilling fluids include providing hydrostatic pressure to prevent formation fluids from entering into the borehole, keeping the drill bit cool and clean during drilling, carrying out drill cuttings, and suspending the drill cuttings while drilling is paused and when the drilling assembly is brought in and out of the borehole. Drilling mud may be a source for power generation in downhole tools, such as motors. The drilling mud may be used to drive downhole motors or turbines to provide extra rotation per minute (RPM) to the drill bit. The drilling mud may be used for directional control enabling the wellbore (120) to be steered in a particular direction.

The wellbore (120) includes the borehole that extends from the surface (108) towards a target zone of the formation (104), such as the reservoir (102). An upper end of the wellbore (120), terminating at or near the surface (108), may be referred to as the "uphole" end of the wellbore (120), and a lower end of the wellbore, terminating in the formation (104), may be referred to as the "downhole" end of the wellbore (120). The wellbore (120) may facilitate the circulation of the drilling fluids during drilling operations for the wellbore (120) to extend towards the target zone of the formation (104) (e.g., the reservoir (102)), facilitate the flow of hydrocarbon production (e.g., oil and gas) from the reservoir (102) to the surface (108) during production operations, facilitate the injection of substances (e.g., water) into the formation (104) or the reservoir (102) during injection operations, or facilitate the communication of monitoring devices (e.g., logging tools) lowered into the formation (104) or the reservoir (102) during monitoring operations (e.g., during in situ logging operations).

In one or more embodiments, the well system (106) is provided with a well sub-surface system (122) with a bottom hole assembly (BHA) (151) attached to the drill string (150) made of drill pipes to suspend into the wellbore (120) for performing the well drilling operation. The BHA (151) is the lowest part of the drill string (150) and includes the drill bit, drill collar, stabilizer, etc. Weight is applied to the drill bit by components in the BHA (151). The BHA (151) may be in compression while the rest of the drill string (150) is in tension. Applying weight to the drill bit at high inclinations may become an issue without a tool to aid in weight transfer.

Figure 2:
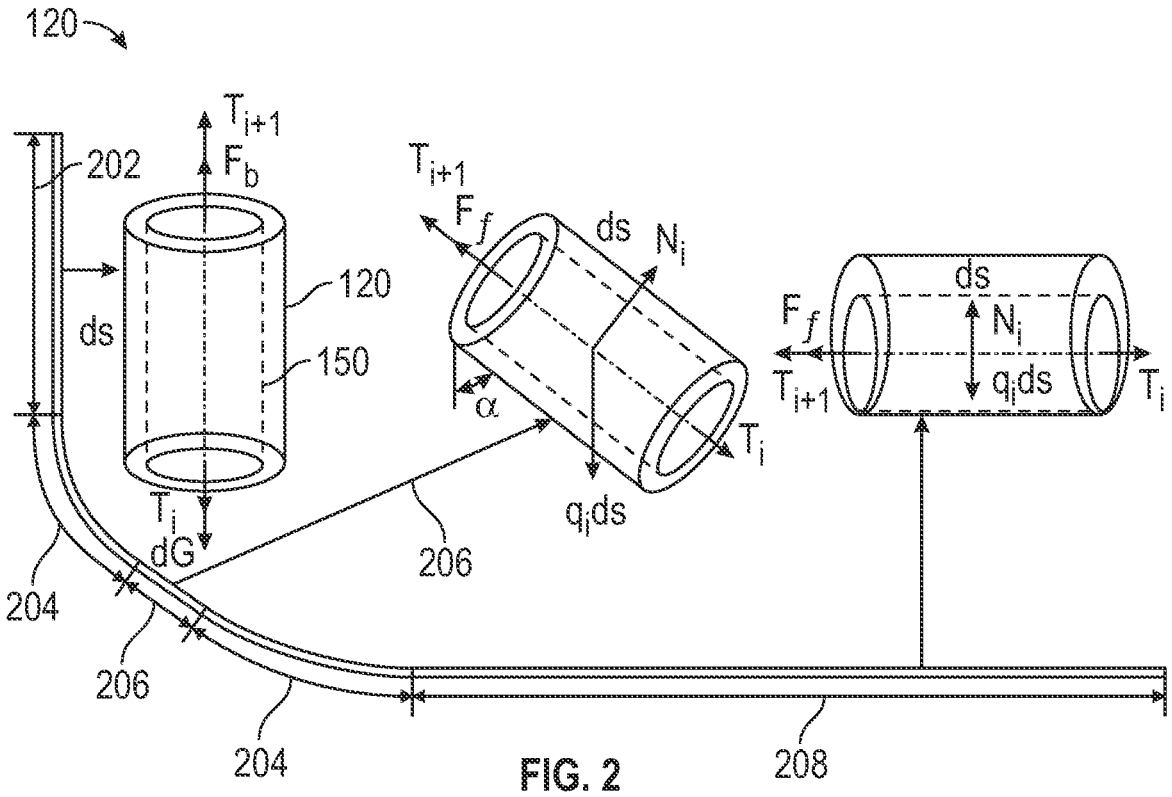
FIG. 2 shows an example of a well with forces in accordance with one or more embodiments.

FIG. 2 illustrates an example wellbore (120) at a high inclination showing a vertical section (202), an inclined straight section (206), inclined curved section (204), and a horizontal section (208) with their appropriate forces at each angle. Someone of ordinary skill in the art will appreciate each section has a corresponding illustration of forces shown by arrows in the figure.

In the vertical section (202) of the wellbore (120), the weight component is aligned with the wellbore (120) and the side force is zero resulting in no drag. The force is all axially aligned along the wellbore (120). As inclination increases into the inclined curved section (204) and inclined straight section (206), the weight component continues to act downwards but the side force component increases until reaching the horizontal section (208). In the horizontal section (208), the weight no longer has any axial component along the wellbore (120) and is all side force resulting in high drag. Applying weight to the drill bit may be a problem as only the non-horizontal components in the drill string (150) are able to contribute. With high angle and extended reach drilling, the large drag forces may exceed the available weight contributing to poor rates of penetration, pipe buckling and twist-offs. The effects may limit the final length of the wellbore (120). There are tools on the market that may help to reduce these effects and help with weight transfer. The tools may include agitation devices to reduce friction and non-rotating string tools that can help to reduce torque. As there is an angular velocity difference between the drill string (150) and non-rotating string tools, the torque applied to the drill string (150) may be larger than expected.

The forces at each angle in FIG. 2 are a result of factors during drilling. Torque is applied to the drill string (150) during drilling operations. Torque is commonly measured at surface in amps supplied to a Topdrive system. The amps may be converted to other torque units such as foot-pounds (ft-lbs). In one or more embodiment, a sensor may be used to measure torque directly without requiring a conversion. The torque seen at surface (108) is the measure of all the losses in the drill string (150) due to factors such as friction that must be overcome to rotate the drill string (150). Factors that influence the amount of torque required may include but are not limited to well trajectory and tortuosity, mud type and additives, bit interaction with the formation (104), and types of formation rock. The length of the drill string (150) is important in that the greater the length of the drill string (150) the greater the possibility of interaction with the formation (104) and larger friction generated.

One of ordinary skill in the art will appreciate that "normal torque" may be expected by computer modeling for the current situation and the value may be very low or high depending on the factors as listed previously. In extended reach drilling (ERD), high torque may be expected due to wellbore shape, length and propensity for drill strings (150), and poor hole cleaning. A higher than expected torque value may be problematic. The Topdrive system has an upper limit. If the upper limit is reached, the Topdrive reduces the torque applied to the drill string (150) to prevent failures. Therefore, the wellbore (120) may not be able to be drilled to the target depth.

Because of this some coiled tubing and wireline operations employ the use of downhole tractors that can be electrically powered to pull the tools into the well. Consistent weight on bit is important to lead to steady torque for better bit performance and a less likelihood to initiate damaging shocks and vibration. A downhole device that can apply an axial thrust to keep the bit engaged with the rock would, therefore, be advantageous when drilling high angle or horizontal wells.

Figure 3:
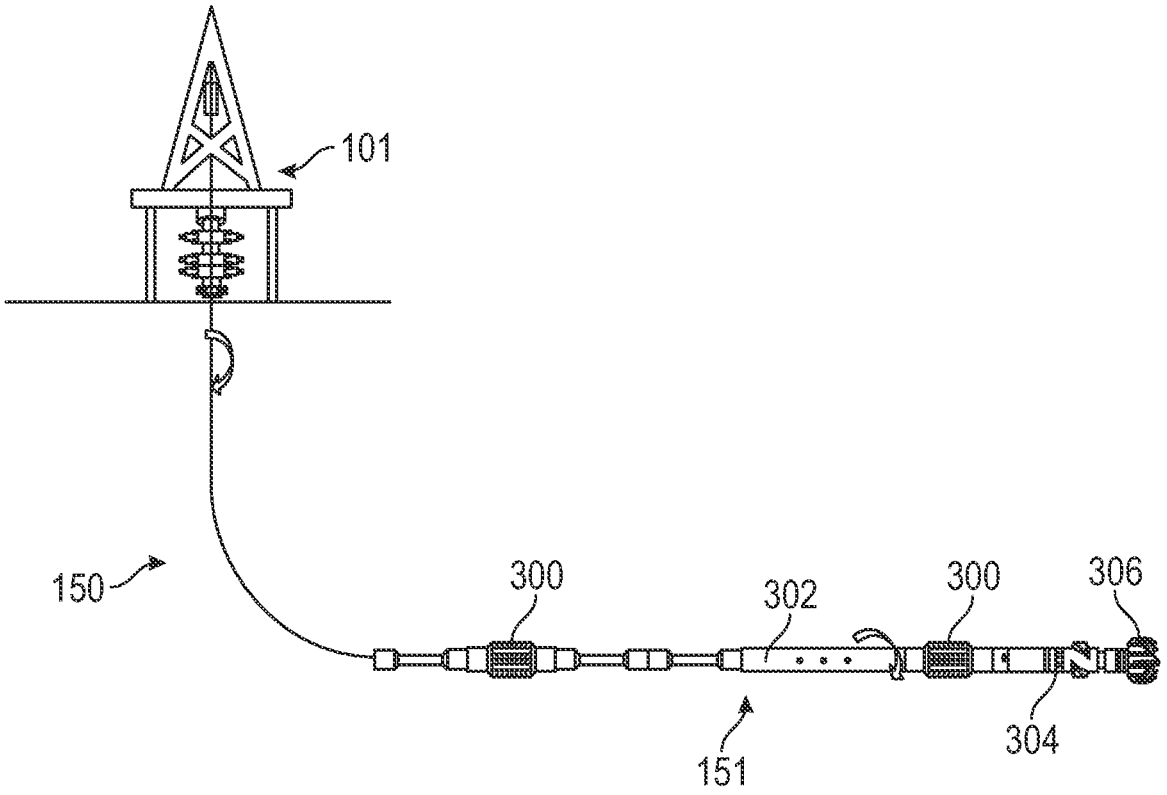
FIG. 3-5 show example systems with a device in accordance with one or more embodiments.
Figure 4:
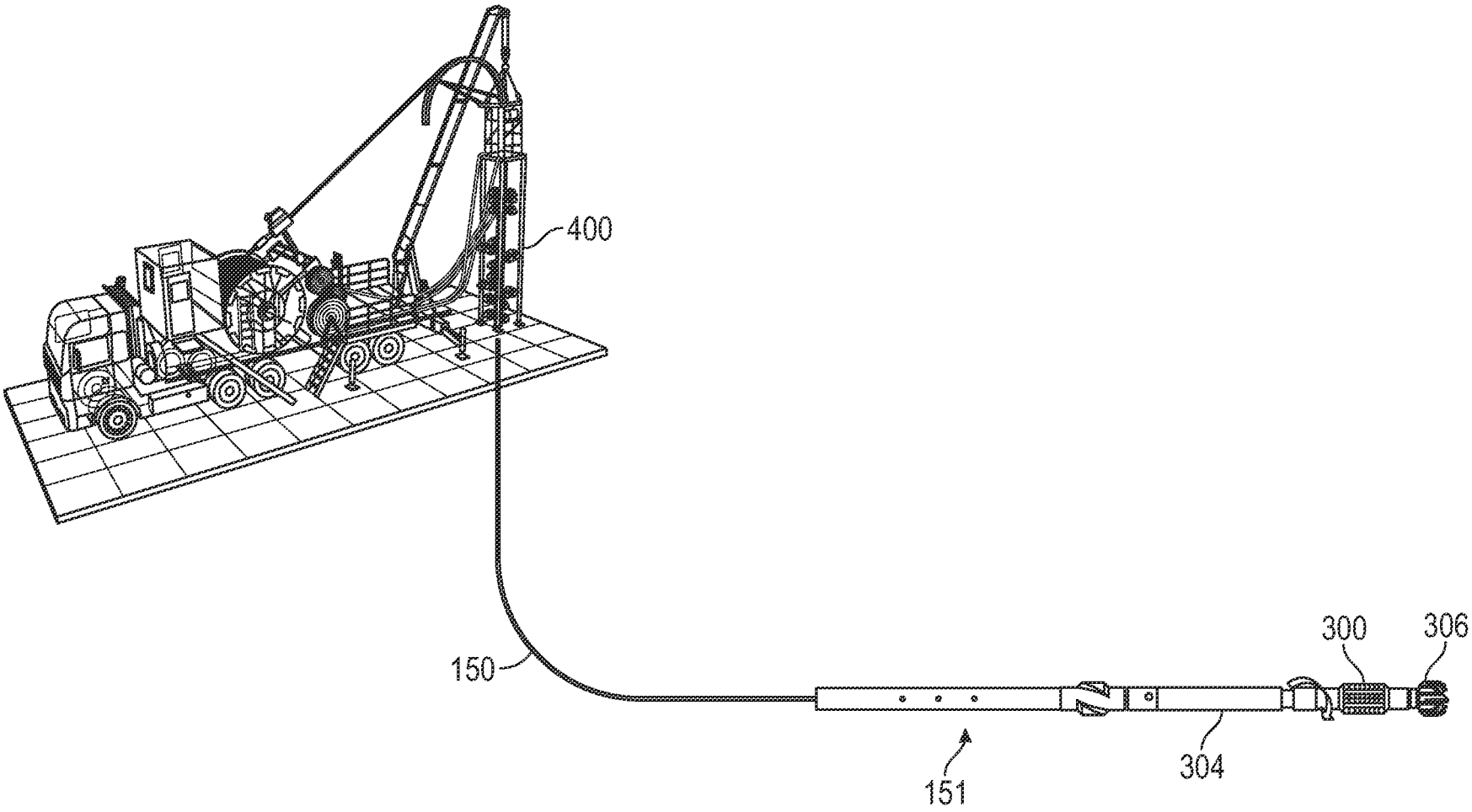
Figure 5:
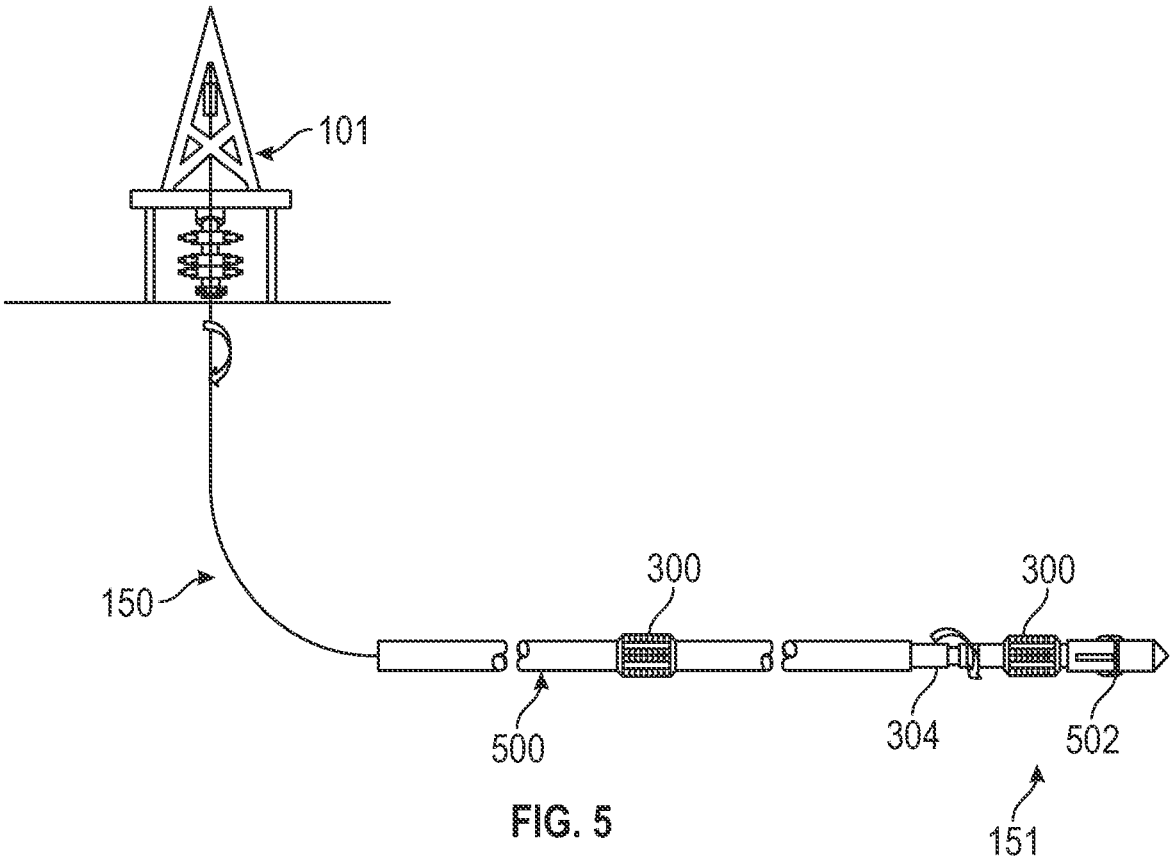

FIGS. 3-5 show examples of potential arrangements for incorporating a downhole drilling tractor tool (300) into the BHA (151) on the drill string (150) in accordance with one or more embodiments. The BHA (151) is shown in FIGS. 3-5 with elements including the drilling tractor tool (300), drill collars (302), motor (304), and bit (306). In conventional drilling, operations may include a Topdrive to rotate the drill string (150). In one or more embodiments, the drill string (150) is held stationary while the motor (304) turns the drill bit (306).

The drilling tractor tool (300) may be placed where large drag forces on the drill string (150) are expected, such as near the bit (306), motor (304), or drill collar (302). The drill collar (302) may include a measurement while drilling tool such as a logging while drilling tool. The drilling tractor tool (300) may use rotational torque and convert it to forward thrust. The rotational torque may come from the well component (134) either on surface (108) or downhole. In one or more embodiments, one or more of the modules and/or elements shown in FIGS. 3-5 may be omitted, repeated, combined and/or substituted. Accordingly, embodiments disclosed herein should not be considered limited to the specific arrangements of modules and/or elements shown in FIGS. 3-5.

In FIG. 3, a system is shown in accordance with one or more embodiments. The drilling tractor tool (300) may be installed in a rig (101) operation. One drilling tractor tool (300) may be installed uphole from the motor (304) or rotary steerable tool (RSS) driven by rotation from surface (108). Another drilling tractor tool (300) may be positioned a distance from the other drilling tractor tool (300) to provide thrust in an additional location. The limit on the number of drilling tractor tools (300) may be dependent on the extra torque requirement on the rotary drive system.

In FIG. 4, a system is shown in accordance with one or more embodiments. The drilling tractor tool (300) may be installed downhole from the motor (304) in a Coiled Tubing Drilling (CTD) application using a CTD Unit (400). Coiled tubing may be used in the drill string (150). A person of ordinary skill in the art would appreciate that although no surface rotation is possible, the rotational torque may be supplied by the motor (304).

In FIG. 5, a system is shown in accordance with one or more embodiments. The drilling tractor tool (300) may be installed in a rig (101) operation. The drilling tractor tool (300) may be installed downhole from a string of casing (500) with a motor (304). The motor (304) may be a disposable motor. A disposable motor may be a motor (304) of lesser specification than motors (304) used in drilling. It is common for the motor (304) to normally drive a reamer shoe (502) to restore the borehole outer diameter and ream over restrictions when running the casing (500). The reamer shoe (502) may be a casing shoe to guide the casing (500) to total depth. The reamer shoe (502) may help navigate ledges and obstructions in the wellbore (120). Placing multiple drilling tractor tools (300) on the casing (500) may act as centralizers and provide axial thrust. Placing the drilling tractor tool (300) between the motor (304) and the reamer shoe (502) may aide in activating the drilling tractor tool (300) through motor (304) rotation and driving the reamer shoe (502).

In FIGS. 6-9, a device is shown in accordance with one or more embodiments. The drilling tractor tool (300) is shown. The drilling tractor tool (300) may include a rotating mandrel (600), a static sleeve (602), and a plurality of force applicators (604). The rotating mandrel (600) is configured to rotate with the drill string (150). The rotating mandrel (600) may have an engagement part (606). The rotating mandrel (600) may be circular in shape with one or more engagement parts (606) making non-circular sections of the rotating mandrel (600), such as a cam. The rotating mandrel (600) may be non-circular in shape and include one or more engagement parts (606), such as lobes. The static sleeve (602) is disposed on the rotating mandrel (600). The static sleeve (602) is configured to remain stationary during rotation of the rotating mandrel (600). The static sleeve (602) may be free to rotate on the drill string (150) or rotating mandrel (600) such that the drill string (150) and rotating mandrel (600) may turn while the static sleeve (602) is stationary. The static sleeve (602) may be in contact and resting against the wellbore (120). The static sleeve (602) may locally space and lift a portion of the drill string (150) such that the drill string (150) may rotate without dragging against the wellbore (120). The static sleeve (602) may include a plurality of pockets (608) that form a pathway from the interior of the static sleeve (602) to the exterior of the static sleeve (602). The pockets (608) may have an angle of 30 degrees or greater in an uphole direction. The pockets (608) may have any angle ranging from 0 degrees to 45 degrees in an uphole direction. The angle of the pockets (608) may be a balance between upward lift and forward thrust. For example, the pocket (608) at 0 degrees may provide only lift and the pocket (608) at 45 degrees may be an even split between lift and thrust.

The plurality of force applicators (604) are each disposed in a respective pocket (608). The force applicators (604) may extend through the pocket (608) and apply a forward thrust to the drill string (150) when extended. As the rotating mandrel (600) rotates, the engagement part (606) of the rotating mandrel (600) comes into contact with each force applicator (604) causing the force applicators (604) to extend. The force applicators (604) may be any type of tool able to apply a push force such as pads.

The rotating mandrel (600) may include one or a plurality of engagement parts (606) to cause the force applicator (604) to extend once or multiple times during every revolution of the rotating mandrel (600). The engagement parts (606) may be cams attached to the rotating mandrel (600) or lobes formed due to the rotating mandrel (600) being of a non-cylindrical cross-sectional shape. The cam height or lobe height may be set to ensure that the force applicator (604) is extended to a maximum from the pocket.

In one or more embodiments, the plurality of raised engagement parts (606) may not have uniform heights so as not to provide the same force applicator (604) lift; therefore, the force applicator (604) may extend by different distances at contact with each respective engagement part (606). In one or more embodiments, the pockets (608) may include identical or different angles such that the force applicator (604) extension and/or retraction is identical or uneven per each contact with an engagement part (606) during every revolution of the rotating mandrel (600).

As each force applicator (604) extends, axial thrust is generated pushing the drill string (150) forward. The sequential extension of force applicators (604) may create a series of thrusts. The series of thrusts may act in an almost continuous operation, particularly when the force applicators (604) are advantageously timed, such as cam timing, helix angle, number of lobes etc. The series of thrusts may be analogous to a crawling insect, with waves or ripples of leg movement to propel the insect forward.

The force applicators (604) may extend longitudinally along the static sleeve (602) and may use multiple engagement part (606) profiles along the length to allow cam timing to vary at different locations. For example, the first circumferential ring of force applicators (604) may be advanced or delayed when the first engagement part (606) is positionally rotated relative to the second engagement part (606). The engagement part (606) profiles may be the same or different for each location. The duration at maximum and minimum extension may be adjusted by including a constant radius on the engagement part (606) profile at maximum or minimum extension such that the force applicator (604) maintains a constant extension for a portion of the rotating mandrel (602) arc of rotation.

FIGS. 6-9 show a cross-section of the drilling tractor tool (300) with two force applicators (604) and one engagement part (606). FIGS. 6-9 show rotation of the rotating mandrel (600) illustrated by an arrow. Continuous rotation of the rotating mandrel (600) may sequentially extend the force applicators (604).

Figure 6A:
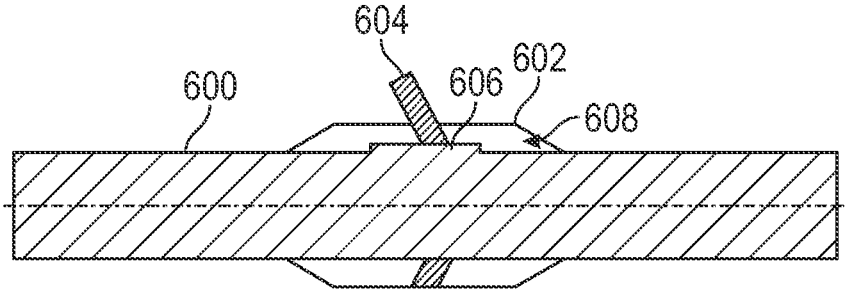
FIG. 6A-6B shows the device with a cross section in accordance with one or more embodiments.
Figure 6B:
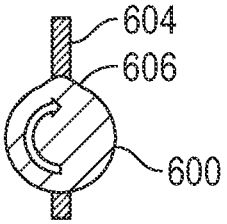

FIG. 6A shows the rotating mandrel (600) with the engagement part (606) in one pocket (608) of the static sleeve (602). The force applicator (604) is shown to be extended when engagement part (606) is in contact with one of the pockets (608). The other force applicator (604) is not in contact with the engagement part (606) and is therefore shown not extended. FIG. 6B shows a top view of the cross-section with the static sleeve (602) hidden and illustrates the rotation of the rotating mandrel (600).

Figure 7A:
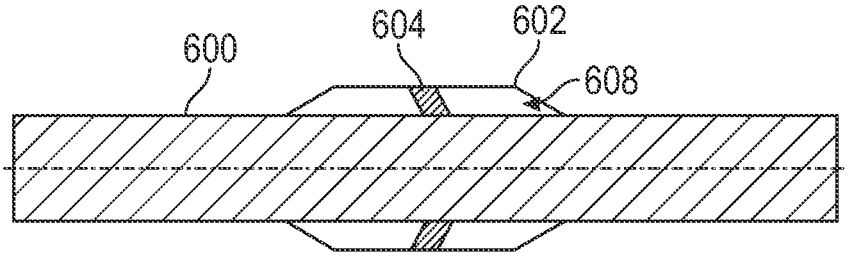
FIG. 7A-7B shows the device with a cross section in accordance with one or more embodiments.
Figure 7B:
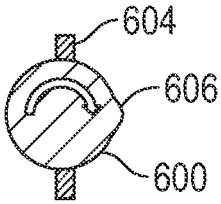

FIG. 7A shows the rotating mandrel (600) rotated by 90 degrees. The force applicator (604) which was previously extended in FIG. 6A has moved back and is flush with the static sleeve (602). FIG. 7B shows the top view of the cross-section with the engagement part (606) not in contact with the force applicator (604).

Figure 8A:
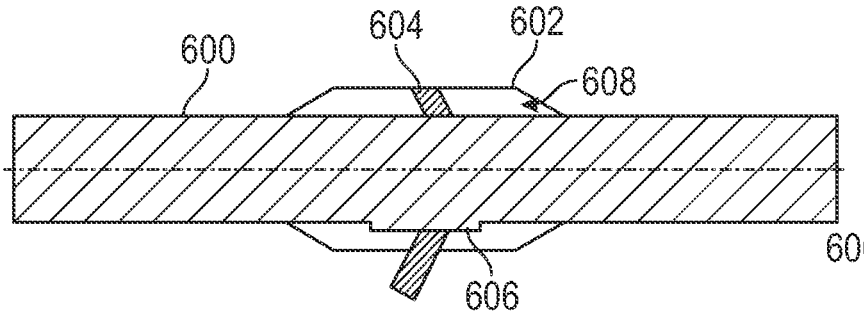
FIG. 8A-8B shows the device with a cross section in accordance with one or more embodiments.
Figure 8B:
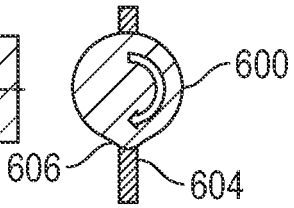

FIG. 8A shows further rotation of the rotating mandrel (600) with the engagement part (606) in contact with the other force applicator (604). The force applicator (604) is shown extended. FIG. 8B shows the top view of the cross-section with the engagement part (606) in contact with the force applicator (604).

Figure 9A:
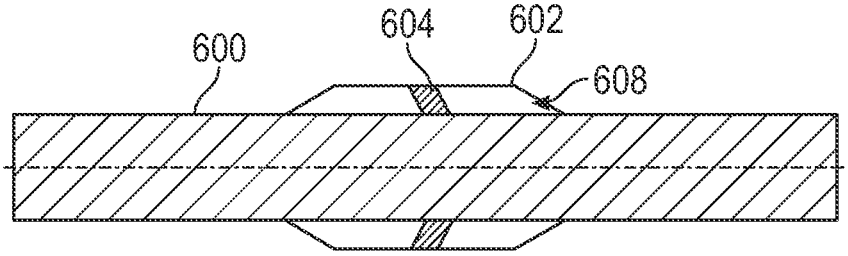
FIGS. 9A-9B shows the device with a cross section in accordance with one or more embodiments.
Figure 9B:
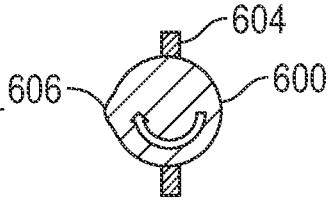

FIG. 9A shows the main body rotated by 270 degrees. The previously extended force applicator (604) from FIG. 8A is retracted. FIG. 9B shows the top view of the cross-section with the engagement part (606) not in contact with the force applicator (604).

Figure 10A:
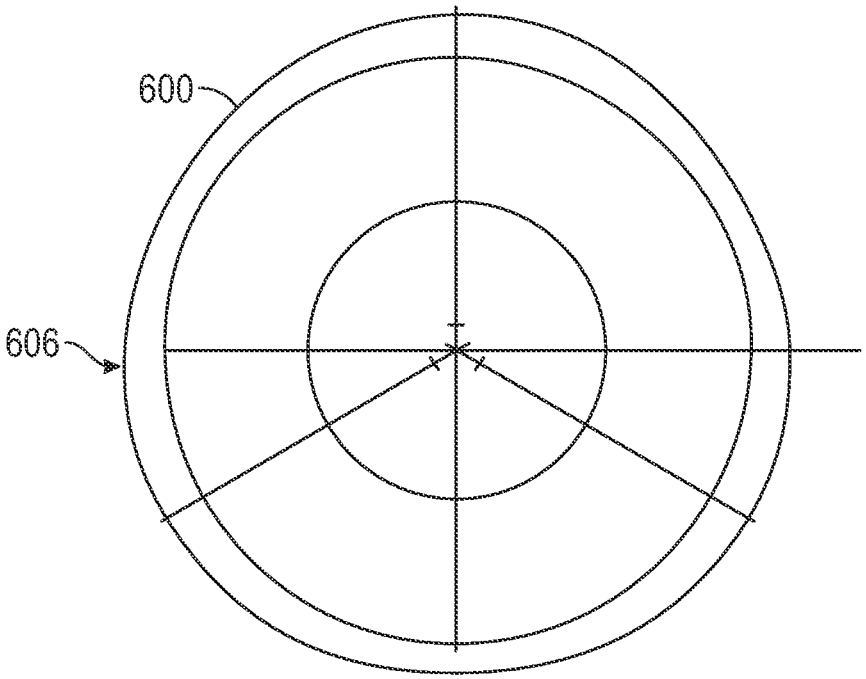
FIGS. 10A-10C show example views and cross section of the device in accordance with one or more embodiments.
Figure 10B:
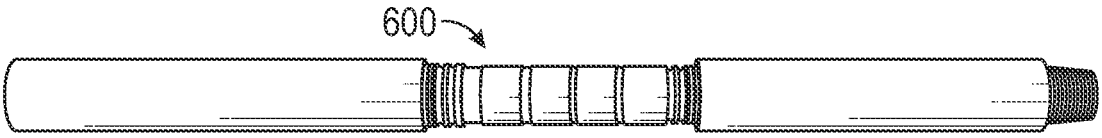
Figure 10C:
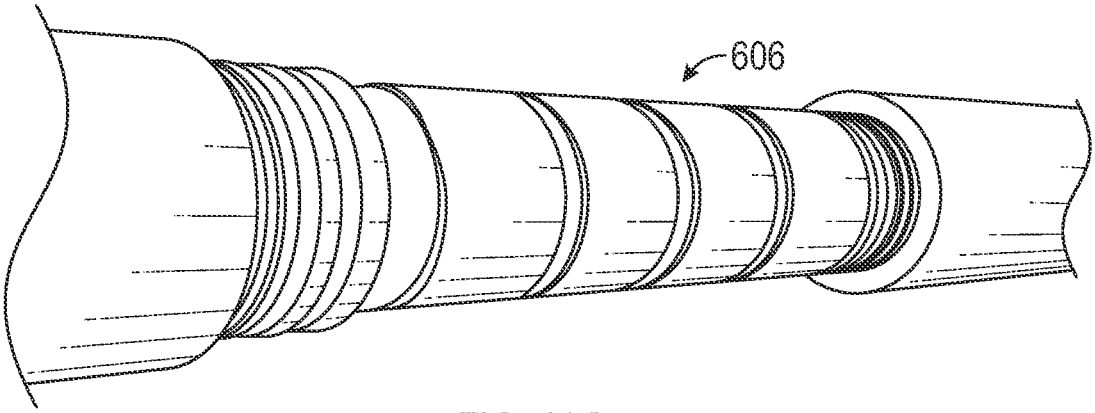

FIG. 10A shows a dimensioned cross-section view of the rotating mandrel (600) with three engagement parts (606). The engagement part (606) may be any shape possible to keep the rotating mandrel (600) rotating and engage with the force applicators (604). Specific to this example, each force applicator (604) will extend three times with each full rotation. In this example, the radial shift of each engagement part (606) is 0.1 inches as shown. FIG. 10B shows the rotating mandrel (600). FIG. 10C shows a closer view of the rotating mandrel (600) with the engagement part (606). The rotating mandrel (600) may include multiple parts to allow assembly. In FIGS. 10B and 10C, multiple parts are shown threaded together to allow the static sleeve (602) to be installed after.

Figure 11:
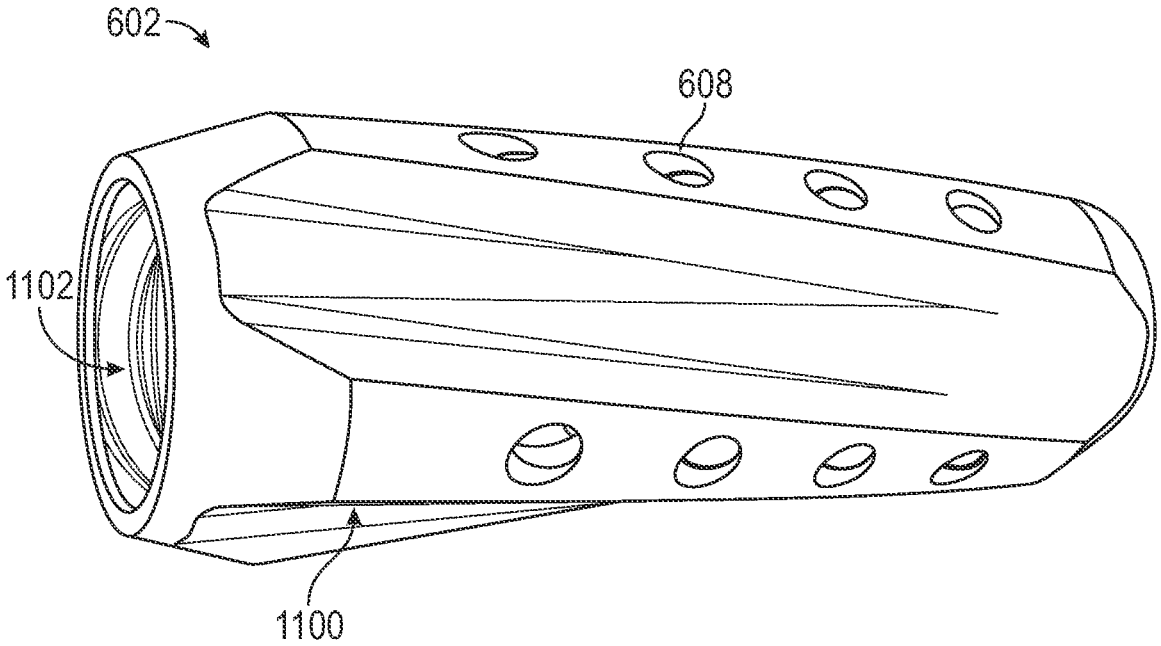
FIG. 11 shows an example of a static sleeve in accordance with one or more embodiments.

FIG. 11 shows an example of the static sleeve (602). The exterior of the static sleeve (602) may contain a plurality of flutes (1100). The flutes (1100) may be grooves that twist around the static sleeve (602). The plurality of flutes (1100) is shown in FIG. 11 on the exterior of the static sleeve (602). For example, the flutes (1100) may be helical in shape. The force applicators (604) may be placed through holes aligned with the helical flutes (1100). The flutes (1100) may be equally aligned to be straight or any other suitable positioning. The force applicators (604) may or may not align with the flutes (1100). The pockets (608) for the force applicators (604) may be angled backward, i.e., not simply radially aligned. The extension of an angled force applicator (604) may generate an axial and radial thrust force. As discussed in other embodiments, the static sleeve (602) may be free to rotate when mounted on the rotating mandrel (600). The static sleeve (602) may freely rotate via a plurality of bearings (1102) on the static sleeve (602). The bearings (1102) may be a mechanical part with the ability to aid in rotation.

Figure 12A:
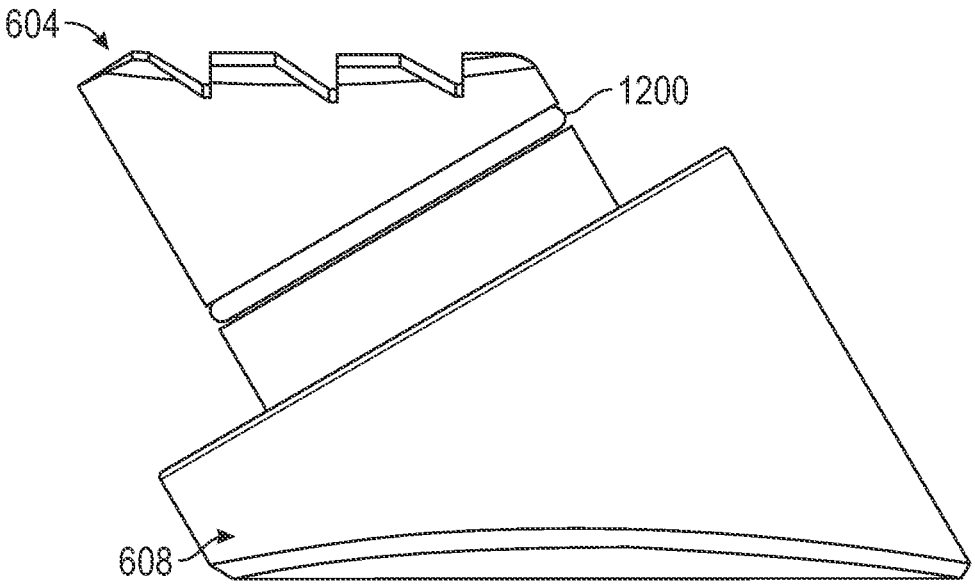
FIGS. 12A-12B shows an example of a force applicator in accordance with one or more embodiments.
Figure 12B:
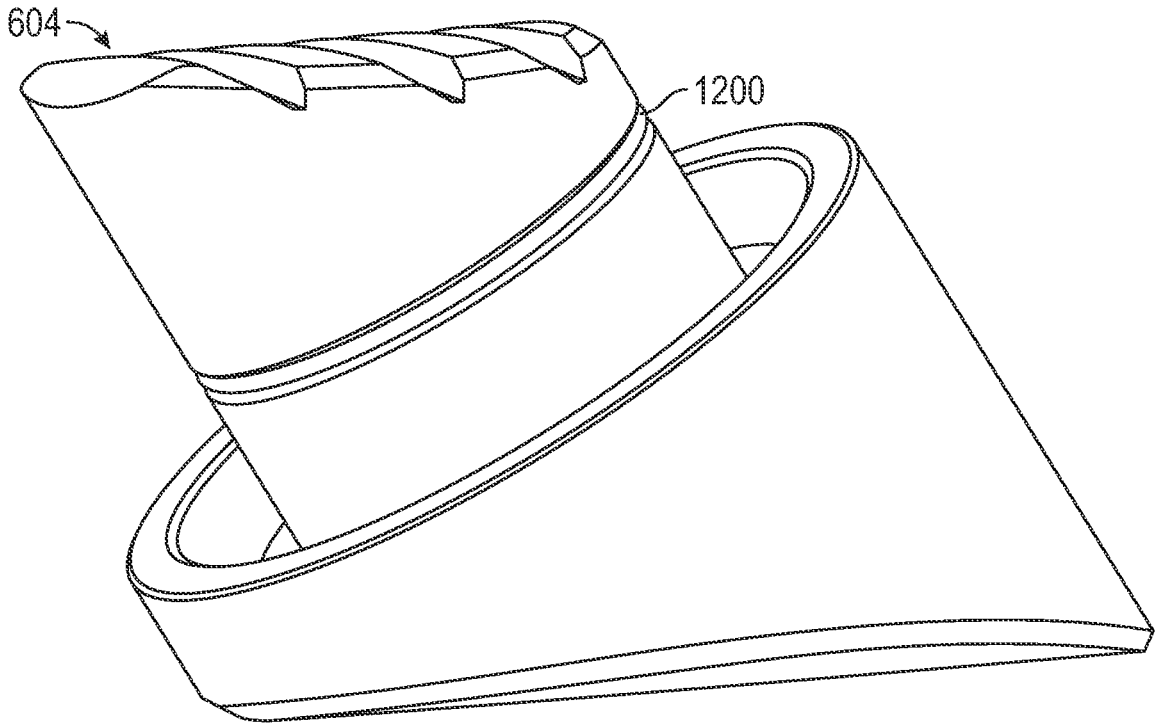

FIGS. 12A-12B show an example design of a force applicator (604) in accordance with one or more embodiments. FIG. 12A shows the force applicator (604) in 2-dimensions (2D). FIG. 12B shows the force applicator (604) in 3-dimensions (3D). The force applicator (604) may have a revolved cylindrical cross-section with angled ends such that the base is planar to the engagement part (606) on the rotating mandrel (600). The top of the force applicator (604) may be flush with the static sleeve (602) outer diameter when the force applicator (604) is retracted. The force applicator (604) may have a serrated face to provide grip in the wellbore (120). The force applicators (604) may include a gasket to keep debris out of the respective pocket (608) containing the force applicator (604), such as an o-ring (1200).

The force applicator (604) may include a mechanism to forcibly retract the extended force applicator (604) and maintain contact with the engagement part (606), such as a compression spring. Each force applicator (604) may extend and retract as the engagement part (606) acts on the force applicator (604). The force applicator (604) may not fully retract before it is extended again. The force applicator (604) may partially retract before extending again. Force applicators (604) may extend longitudinally along the drilling tractor tool (300). For example, the force applicator (604) may extend following a flute (1100) helix. The force applicators (604) may vary in size and/or shape. Inclination of angle of the force applicator (604) may increase axial movement for a given extension. The underside of the force applicator may be changed. The underside may be the portion of the force applicator (604) which is in contact with the engagement part (606). The underside may be flat or curved in the opposite direction providing a different contact regime with the engagement part (606). In some instances, it may be undesirable for the force applicator (604) to be forcibly driven out if the wellbore (120) geometry prevents the extension. For these instances, the force applicator (604) may include deformable, compressible, or elastic elements to flex or deform, if the force applicator (604) is unable to extend.

The force applicator (604) may have an angle of 30 degrees or greater in an uphole direction dependent on the pocket (608) angle. The angle of the force applicator (604) may change the thrust to lift ratio. The angle of the force applicator (604) may reduce the parasitic torque of the drilling tractor tool (300). The angle of the force applicator (604) may depend on the ratio of upper Topdrive limit vs expected torque levels. For example, if there are 16 force applicators (604) drilled at 80 RPM angled back at 30 degrees each lifted vertically 0.1 inches with horizontal travel of 0.06 inches at full extension, the drive may be 230 inches per minute if all force applicators (604) made contact generating maximum forward thrust. In an initial finite element method (FEA) study with basic non-optimized geometry, each force applicator (604) is shown with the ability to comfortably lift at least 14,000 pound-force (lbf). This may be 7,000 lbf axial thrust and 12,120 lbf radial lift. A typical drill collar (302) may weigh around 3,500 lbs. Each force applicator (604) may lift 90 ft of horizontal drill collars (302). Each force applicator (604) may drive the BHA (151) forward with 7,000 lbf during extension.

Figure 13:
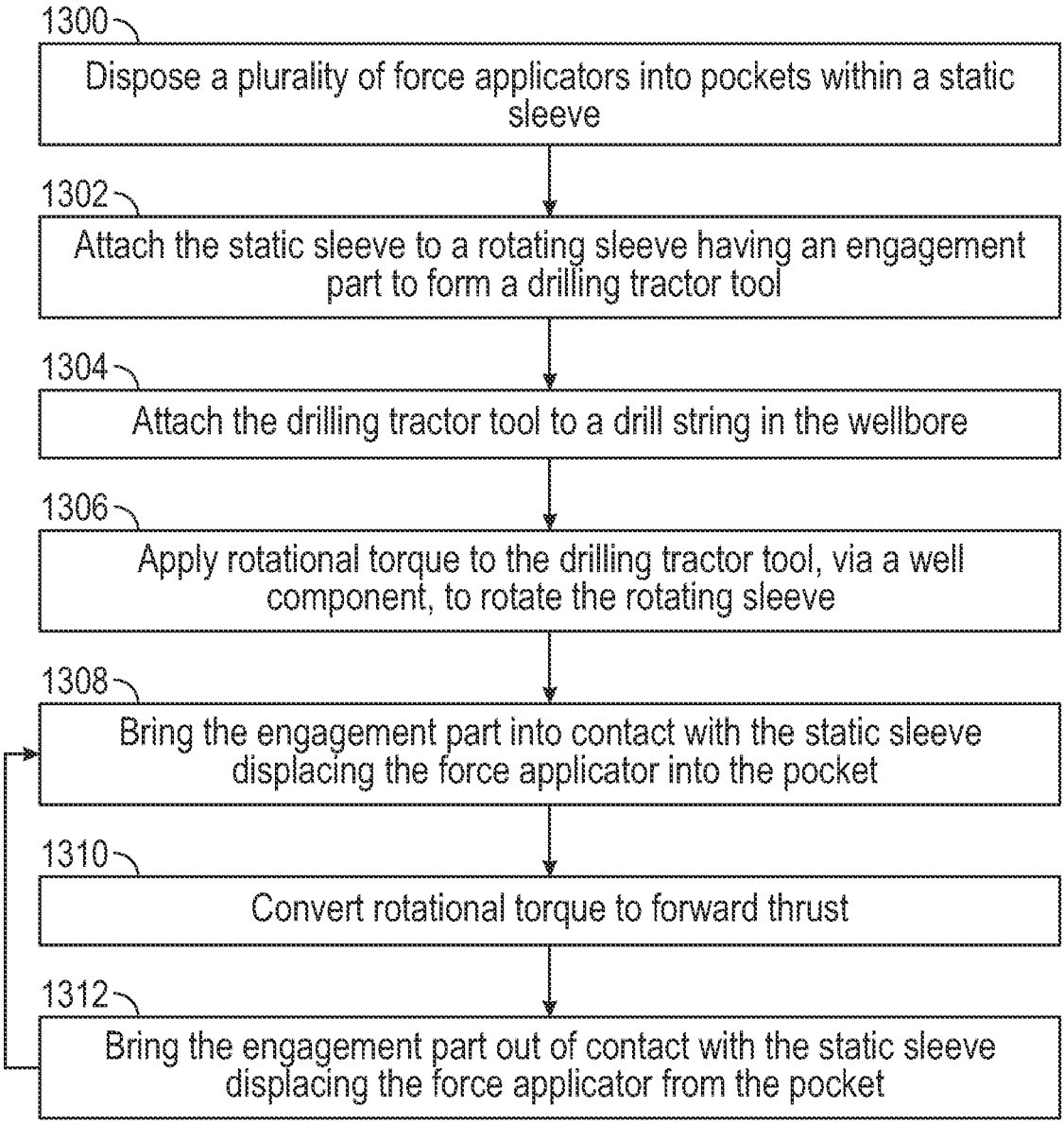
FIG. 13 shows a flowchart in accordance with one or more embodiments.

FIG. 13 shows a flowchart in accordance with one or more embodiments. Specifically, FIG. 13 shows a method and apparatus for the drilling tractor tool (300). One or more blocks in FIG. 13 may be performed using one or more components as described in FIGS. 1 through 12. While the various blocks in FIG. 13 are presented and described sequentially, one or ordinary skill in the art will appreciate that some or all of the blocks may be executed in parallel and/or iteratively. Furthermore, the blocks may be performed actively or passively.

In Block 1300, a plurality of force applicators (604) are disposed into pockets (608) within a static sleeve (602). The plurality of force applicators (604) may be pads. The force applicators (604) may have an angle of 30 degrees or greater in a direction uphole. The force applicators (604) may have an o-ring (1200) to keep debris out of the respective pockets (608). The force applicator (604) may have a serrated face to provide grip in the wellbore (120). The static sleeve (602) may include a plurality of flutes (1100) for fluids to pass through. In Block 1302, the static sleeve (602) is attached to a rotating mandrel (600) having an engagement part (606) to form the drilling tractor tool (300). The static sleeve (602) may include a plurality of bearings to freely rotate the static sleeve (602) on the rotating mandrel (600). The static sleeve (602) and rotating mandrel (600) are attached such that rotation of the rotating mandrel (600) displaces the plurality of force applicators (604) from the pockets (608) within the static sleeve (602) as the rotating mandrel (600) rotates.

In Block 1304, the drilling tractor tool (300) is attached to the drill string (150) in the wellbore (120). In Block 1306, rotational torque is applied to the drilling tractor tool (300), via a well component (134), to rotate the rotating mandrel (600). The well component (134) may be a top drive or rotary table on surface. The well component (134) may be a downhole device such as a motor (304). In Block 1308, the engagement part (606) is brought into contact with the static sleeve (602) displacing the force applicator (604) into the pocket (608). The rotation of the rotating mandrel (600) displaces the force applicators (604) from the pockets (608) within the static sleeve (602) as the rotating mandrel (600) rotates thereby bringing the engagement part (606) in and out of contact with the static sleeve (602). The engagement part (606) may be a lobe. The force applicator (604) may have a compression spring to aide in displacement into the pocket (608). The engagement part (606) may come into contact with one or more force applicators (604) to displace them into their respective pockets (608).

The rotational torque is then converted into forward thrust (Block 1310). In Block 1312, the engagement part (606) is brought out of contact with the static sleeve (602) displacing the force applicators (604) from the pockets (608). The engagement part (606) may come into contact with a force applicator (604) while coming out of contact with another force applicator (604). Blocks 1308 through 1312 may be cycled or performed simultaneously dependent on the arrangement and design of the drilling tractor tool (300).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A drilling tractor tool in a drill string comprising:

a rotating mandrel having an engagement part configured to rotate with the drill string;

a static sleeve disposed on the rotating mandrel configured to remain stationary during rotation of the rotating mandrel, the static sleeve comprising a plurality of pockets that form a pathway from an interior of the static sleeve to an exterior of the static sleeve; and a plurality of force applicators each disposed in a respective pocket of the plurality of pockets of the static sleeve, the plurality of force applicators configured to extend through the respective pocket and apply a forward thrust to the drill string when extended, wherein the engagement part of the rotating mandrel is configured to contact and cause to extend each of the plurality of force applicators respectively as the rotating mandrel rotates.

2. The drilling tractor tool of claim 1, wherein the static sleeve comprises a plurality of flutes disposed on the exterior of the static sleeve.

3. The drilling tractor tool of claim 1, wherein the plurality of force applicators are pads.

4. The drilling tractor tool of claim 1, wherein the engagement part is a cam or a lobe.

5. The drilling tractor tool of claim 1, wherein each of the pockets has an angle ranging from 0 degrees to 45 degrees that is in an uphole direction.

6. The drilling tractor tool of claim 1, wherein the static sleeve comprises a plurality of bearings configured to freely rotate the rotating mandrel inside the static sleeve.

7. The drilling tractor tool of claim 1, wherein each of the plurality of force applicators comprises an o-ring configured to keep debris out of the respective pocket containing the force applicator.

8. The drilling tractor tool of claim 7, wherein the force applicator comprises a serrated face to provide grip in a wellbore.

9. The drilling tractor tool of claim 1, wherein each of the plurality of force applicators comprises a compression spring.

10. A method for drilling a wellbore, the method comprising:

disposing a plurality of force applicators into pockets within a static sleeve;

attaching the static sleeve to a rotating mandrel having an engagement part so as to form a drilling tractor tool, wherein the static sleeve and the rotating mandrel are attached such that rotation of the rotating mandrel displaces the plurality of force applicators from the pockets within the static sleeve as the rotating mandrel rotates thereby bringing the engagement part into and out of contact with the static sleeve;

attaching the drilling tractor tool to a drill string in the wellbore;

applying a rotational torque to the drilling tractor tool, via a well component, to rotate the rotating mandrel, wherein the rotational torque is converted to a forward thrust, through the displacement of the plurality of force applicators via the engagement part coming in contact with the static sleeve, and wherein the plurality of force applicators retract via the engagement part coming out of contact with the static sleeve.

11. The method of claim 10, wherein the static sleeve comprises a plurality of flutes for fluids to pass through.

12. The method of claim 10, wherein the plurality of force applicators are pads.

13. The method of claim 10, wherein the engagement part is a cam or a lobe.

14. The method of claim 10, wherein each of the pockets has an angle ranging from 0 degrees to 45 degrees that is in an uphole direction.

15. The method of claim 10, wherein the static sleeve comprises a plurality of bearings configured to freely rotate on the rotating mandrel inside the static sleeve.

16. The method of claim 10, wherein each of the plurality of force applicators comprises an o-ring configured to keep debris out of the respective pocket containing the force applicator.

17. The method of claim 16, wherein the force applicator comprises a serrated face to provide grip in a wellbore.

18. The method of claim 10, wherein each of the plurality of force applicators comprises a compression spring.

19. The method of claim 10, wherein the well component is top drive or rotary table.

20. The method of claim 10, wherein the well component is a downhole device such as a motor.

* * * * *